United States Patent [19]

Lichtenstein

[11] 4,178,679

[45] Dec. 18, 1979

[54] CONTACT CRIMPING MACHINE

[76] Inventor: Bernard Lichtenstein, 4-26 Second St., Fair Lawn, N.J. 07410

[21] Appl. No.: 885,768

[22] Filed: Mar. 13, 1978

[51] Int. Cl.[2] ..... H01R 43/04

[52] U.S. Cl. ..... 29/715; 29/753

[58] Field of Search ..... 29/753, 751, 628, 715

[56] References Cited

U.S. PATENT DOCUMENTS

| | | | |
|---|---|---|---|
| 3,004,581 | 10/1961 | Krol et al. | 29/715 X |
| 3,165,139 | 1/1965 | Whitney, Jr. | 29/753 X |
| 3,664,173 | 5/1972 | Haucke et al. | 29/753 X |

*Primary Examiner*—Carl E. Hall

[57] ABSTRACT

A contact crimping machine for use with a pin having a wire receiving seat includes a chamber, a plurality of crimping dies and actuating means for activating the crimping dies. Means are provided selectively to move one of the pins through the chamber into communication with the crimping dies, and restraining means are provided for maintaining a pin in suspended position removed from the actuating means. The contact crimping machine is constructed so that when the pre-stripped end of a wire is placed into the wire receiving seat of a pin, and downward pressure is supplied, the pin engages the actuating means and the crimping dies are momentarily urged against the wire receiving seat thus crimping the pre-stripped end of the wire within the wire receiving seat. Circuit means are provided to automatically position the next pin into place.

6 Claims, 8 Drawing Figures

FIG. 1.
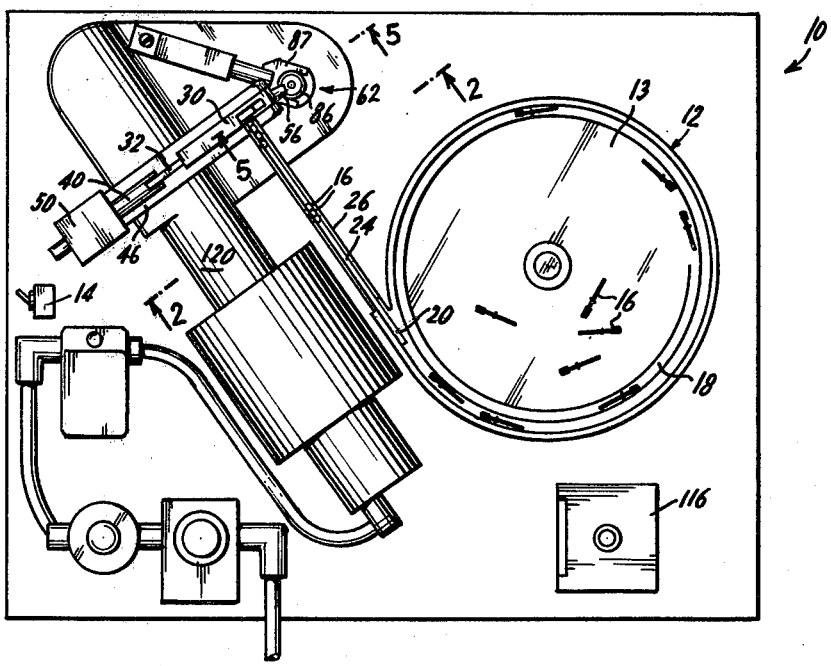
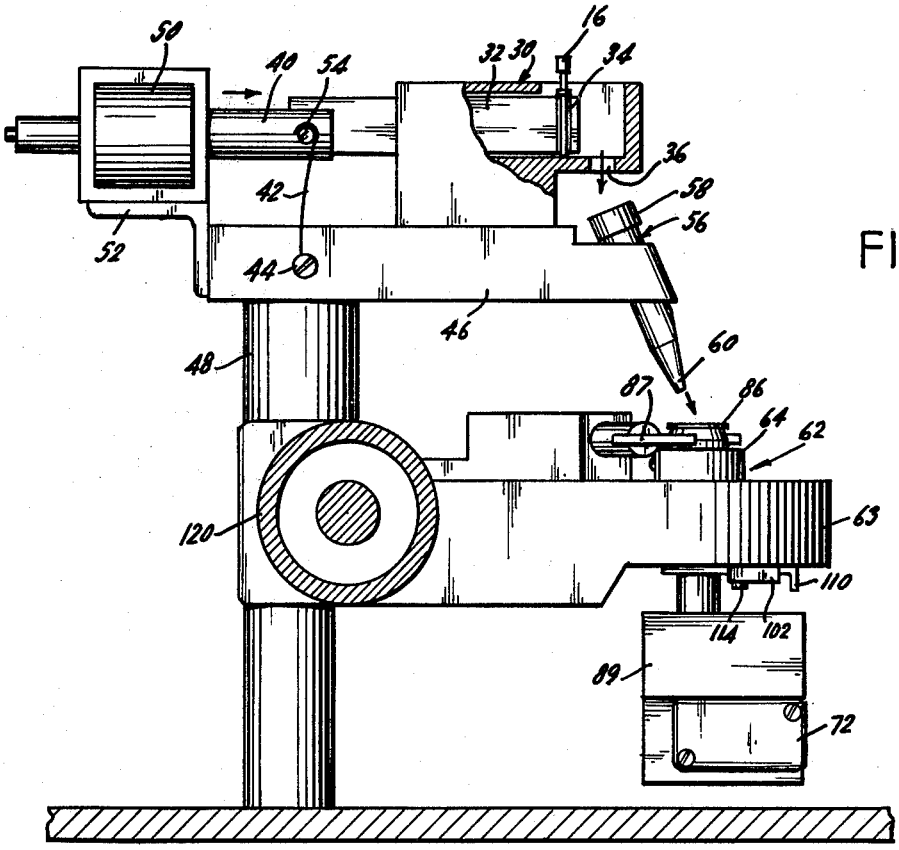
FIG. 2.

CONTACT CRIMPING MACHINE

This invention relates to forming an electrical contact at the end of a wire, and more specifically discloses an apparatus for manufacturing the same.

The fields of microcircuitry, analog computers, switching systems and related applications have produced a need for electrical connectors composed of a flexible wire mounted at its end to a pin-type contact. These connectors are used to form breakable connections between various female receptacles. Because of the large number of applications for such connectors, it has become necessary to produce them in high volume. In addition, the reliability of these connectors is most important. Should the pin become dislodged from its wire, it may be difficult to remove from its female receptacle.

Conventionally, the affixing, or crimping, of pins to wires is done using hand crimpers. This procedure is cumbersome, time-consuming, expensive and unreliable. It is virtually impossible to produce a large quantity of connectors, and those that are produced are subject to failure.

Several automated crimping machines have been developed. These machines tend to be expensive, unduly complicated and to require skilled operators. Also, they generally tend to be used for one size and shape of pin.

It is therefore an object of the present invention to provide an apparatus for crimping a pin about a wire which permits a high volume manufacture.

It is yet another object of the present invention to provide such an apparatus which produces connections of a uniformly high quality, thus avoiding the breakdowns described above.

It is a still further object of the present invention to provide such an apparatus which can be used with more than one size and shape of pin.

It is yet another object of the present invention to provide an apparatus for forming such connectors which does not require a highly skilled operator, and which can produce uniformly high quality results relatively independent of operator skill.

In accordance with an illustrative embodiment demonstrating objects and features of the present invention, an automatic crimping device is provided which is to be used with a pin having a wire-receiving seat axially aligned with an elongated point. The automatic crimping device includes a chamber which has a gate and a port displaced from the gate. Supply means provide a continuous flow of pins at the gate, and means are included to selectively displace one of the pins through this chamber from a first location adjacent the gate to a second location discharged from the port. The apparatus further includes a housing having an entrance positioned to receive a pin when discharged from the port and a bore in axial alignment with this entrance. A plurality of crimping dies in normally spaced relation with each other are radially disposed about the bore below the entrance. Actuating means are mounted within the bore below these crimping dies, and restraining means are provided for selectively retaining one of the pins, after discharge in the port, from a suspended position removed from the actuating means.

The pin is displaced from its suspended position within the bore to its active position by action of the pre-stripped end of a wire which is directed into the wire-receiving seat of the pin, and by downward pressure, overcomes the restraining means and causes the pin to enter the active position. If required, the pre-stripped end may be shorter than the wire-receiving seat depth in which case the insulation butts against the seat rim and provides the downward pressure. When the pin is in its active position, its wire-receiving seat is disposed within the bore radially aligned with the crimping dies. Circuit means are coupled with these actuating means whereby when the actuating means are engaged, the crimping dies are momentarily urged against the wire-receiving seat of a pin, crimping the same about the wire end, and, after a time delay, during which the completed wire-pin assembly is removed through the entrance, another of the pins is displaced into the second location.

It is to be noted that prior to the operation described above, the apparatus has first been primed; that is, a pin has manually been placed into the suspended position and the supply means has provided a continuous supply of pins at the gate, the frontmost of which is in the first location.

In addition, the crimping device can be used without the supply means and the chamber, by manually placing a pin into the suspended position within the housing, and then using the pre-stripped end of the wire to urge the pin into its active location as described above.

Those skilled in the art will appreciate that automatic crimping devices made in accordance with the present invention have several advantages over conventional crimping systems. For example, the crimping dies can only be activated when the pin is in its proper position, and actuation of said crimping dies is determined not by operator decision, but occurs when the properly-positioned pin triggers the actuating means. This avoids the premature crimping which is possible when using conventional crimping systems.

Another benefit of the present invention is the provision for vertical insertion of the wire into the crimping assembly. Vertical insertion is preferable to horizontal insertion first because the assitance of gravity allows for the construction of a simpler, more reliable device; and second, because this configuration has been found to be more comfortable and less fatiguing to the operator.

The above brief description of the present invention will be more fully appreciated by reference to the following detailed description of a presently preferred, but nonetheless illustrative embodiment in accordance with the invention, when taken in conjunction with the accompanying drawing, wherein:

FIG. 1 is a top plan view of an apparatus made in accordance with the present invention;

FIG. 2 is a sectional view taken along lines 2—2 of FIG. 1, showing inner construction details of the apparatus;

Figure 5:
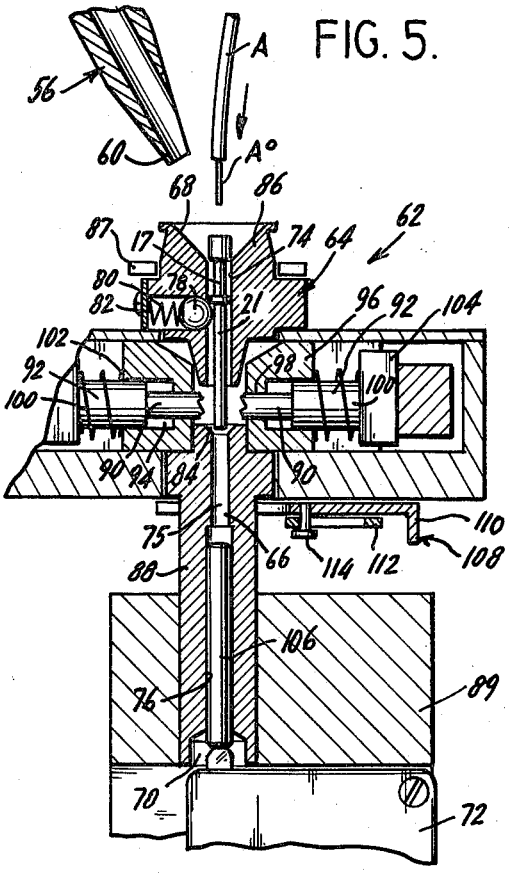
FIG. 5 is a sectional view taken along line 5—5 of FIG. 1, and shows a pin in its suspended position, with a wire ready to be inserted into the housing to start the crimping procedure.

Turning to the drawings, and particularly to FIG. 1, an apparatus made in accordance with the present invention is generally designated by the reference numeral 10. A supply of pins 16 of the type described is deposited within hopper 13 of vibratory feeder 12, which is commercially available from a number of venders. Main power switch 14 also activates vibratory feeder 12, urging pins 16 along bowl track 18 until the first of these reaches channel 20. Pins 16 each include wire-receiving seat 17 axially aligned with elongated point 21. At channel 20, misdirected pins are thrown off, and pins in their properly oriented (that is point down position) are disposed within groove 24 of descending feed track 26.

Figure 3:
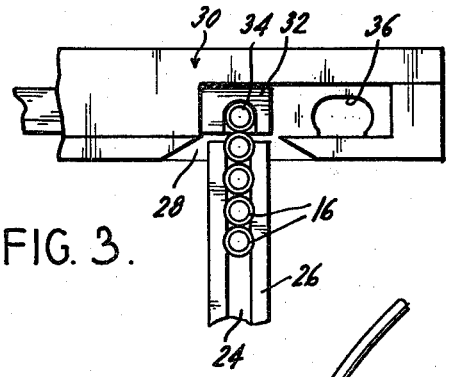
FIG. 3 is an expanded top plan view of the chamber showing the piston in its first position, the seat being aligned with the gate, and showing a row of properly oriented pins presented to the gate; the frontmost of which is in its first location.

As pins 16 move along groove 24, they reach a position adjacent to gate 28 of chamber 30. Piston 32 is slideably mounted within chamber 30, and when piston 32 is in its first position (as shown in FIG. 3) the frontmost of pins 16 is received in seat 34 of piston 32. Port 36 of chamber 30 is the only opening in the bottom surface of chamber 30 and is normally displaced from gate 28. When piston 32 is in its first position, no pin is able to escape through port 36.

Referring to FIG. 2, piston 32 is in its first position, and is attached to armature 40 by screw 54. Leaf spring 42 is mounted through screw 44 to horizontal support member 46 and through screw 54 to armature 40. Armature 40 is mounted within and is activated by coil 50 which is mounted to horizontal support member 46 through L-shaped member 52. Horizontal support member 46 is also mounted to vertical support member 48. Alternatively, a double acting pneumatic piston controlled by an electropneumatic solenoid valve, can be used in place of coil 50 and armature 40.

Also mounted to horizontal support member 46 is chute 56 which has wide opening 58 adjacent to port 36 and narrow opening 60 adjacent to the crimping assembly generally designated by the reference numeral 62 and which will be described below. Both wide opening 58 and narrow opening 60 are wider in cross-sectional dimension than wire-receiving seat 17 of pin 16.

Crimping assembly 62 can best be described by reference to FIGS. 5 and 6. FIG. 5 shows crimping assembly 62 with pin 16 in its first, or suspended, position. Crimping assembly 62 includes housing 64 having bore 66 formed therein. Bore 66 terminates at its top in entrance 68 disposed adjacent to narrow opening 60 of chute 56. Bore 66 terminates at its lower end at chamber 70, and includes upper portion 74, middle portion 75 and lower portion 76. Upper portion 74 is dimensioned to admit wire-receiving seat 17 of pin 16 in slideable relation, and middle section 75 is dimensioned to admit elongated point 21 of pin 16 in slideable relation.

Middle section 75 of bore 66 terminates at its upper end in entrance 84 which is formed to permit the easy entry of elongated point 21 of pin 16.

Pin 16 is retained in suspended position by the action of retaining ball 78 which protrudes through upper portion 74. Retaining ball 78 is urged against pin 16 by the action of spring 80 mounted to retaining ball 78 and mounted to housing 64 at point 82.

Figure 8:
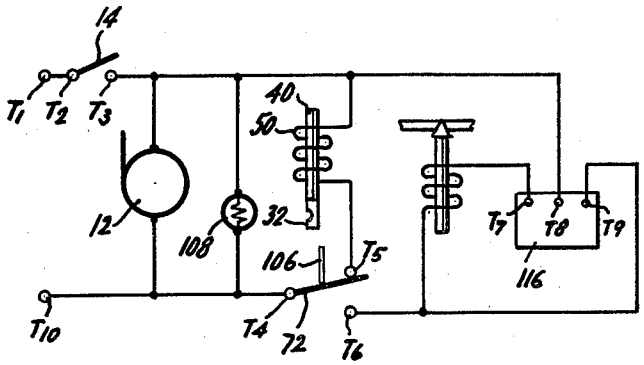
FIG. 8 is a schematic drawing of the piston feed and crimping circuitry.

Housing 64 comprises sections 86 and 88 in normally spaced relation. Crimping dies 90 are radially disposed about the gap formed by sections 86 and 88 of housing 64, and are in axial alignment with each other. Crimping dies 90 protrude through apertures 98 included in structural members 96 and are mounted to crimping pistons 92. Crimping pistons 92 are slideably mounted within crimping chambers 94 and are retained in the position shown in FIG. 5 by action of springs 100 which are mounted to structural members 96 at points 102, and are activated by heads 104. Heads 104 are parts of a commercially available electropneumatic crimping assembly shown generally in FIG. 1 by reference numeral 120. The crimping assembly is available from a number of venders. Heads 104 are powered pneumatically and are activated by an electropneumatic solenoid valve as shown in the circuit of FIG. 8, and which will be described below. Those skilled in the art understand the operation of such electropneumatic crimping assemblies, and the operation of the same will not be further discussed herein.

Plunger 106 is located within lower portion 76 of bore 66 and rests on microswitch 72, but is of insufficient weight to activate the same.

Lower support member 63 is mounted to vertical support member 48, and section 88 of housing 64 is mounted within structural member 89, and is maintained in position relative to lower support member 63 by the action of bracket assembly 108 which comprises L-shaped bracket 110 slideably mounted within housing 112 and retained in position by action of set screw 114. Section 86 of housing 64 is retained in position with respect to structural member 63 by action of brackets 87 which are dimensioned to fit around and secure section 86.

Figure 6:
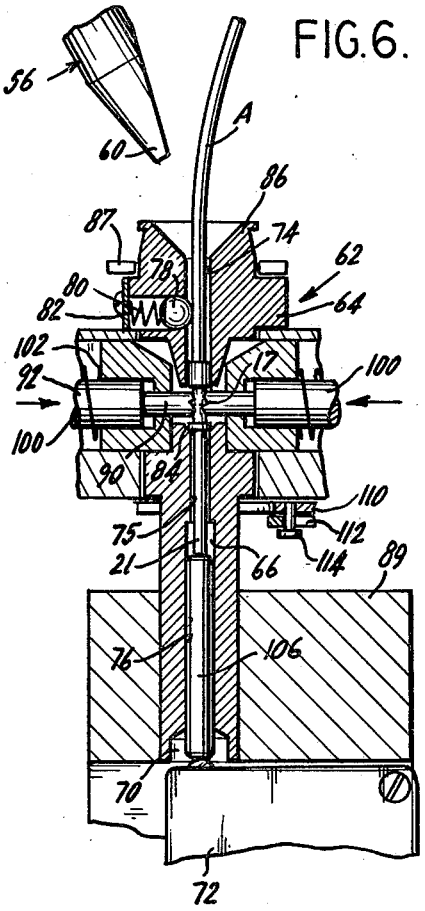
FIG. 6 is a view similar to FIG. 5 and shows the pin in its active position, shows the action of the crimping dies against the wire-receiving seat of the pin, and shows the connector being formed.

Turning to FIG. 6, it can be seen bare end A° of wire A has been received within wire-receiving seat 17 of pin 16, and pin 16 and wire A have overcome the action of spring 80 on retaining ball 78, causing elongated point 21 of pin 16 to be urged downwardly against plunger 106. As can be seen by reference to FIG. 6, the total height of middle portion 75 and lower portion 76 of bore 66 is equal to the sum of the lengths of plunger 106 and elongated point 21 of pin 16. By action of plunger 106 against microswitch 72, the electropneumatic circuit has been activated and crimping dies 90 have crimped wire-receiving seat 17 of pin 16 around bare end A° of wire A. When dies 90 are automatically released, the now completed wire and pin assembly B can be retracted from upper section 86 of housing 64 through entrance 68 as can be seen by reference to FIG. 7.

FIG. 8 is a schematic drawing showing the electrical circuit used to activate the apparatus. Terminals T1 and T10 are connected to a standard 110 volt, 60 cycle power supply (not shown). Terminal T1 is connected to terminal T2 of main power switch 14. Closing main power switch 14 causes current to slow through terminal T3 thus activating vibratory feeder 12. Coupled in parallel connection with vibratory feeder 12 is fuse 108, normally 5 amps in size, to protect the circuitry. Microswitch 72 is in its normally deactivated position when the apparatus is in the condition shown in FIG. 5. When microswitch 72 is activated by action of plunger 106 (as shown in FIG. 6) microswitch 72 momentarily moves to its closed position, causing current to flow between terminals T4 and T6. This activates pneumatic assembly 120, directing crimping dies 90 to the position shown in FIG. 6. Relay 116 is a commercially available product, for example, Model No. TS 2421 sold by Relay Specialties, Inc. of Fairlawn, New Jersey. When current flows between terminals T4 and T6, relay 116 is activated, and after a time delay, coil 50 and armature 40 are activated, causing piston 32 to momentarily enter its second position shown in FIG. 4. Action of leaf spring 42 next causes the piston 32 to return to its first position as shown in FIG. 3.

Figure 4:
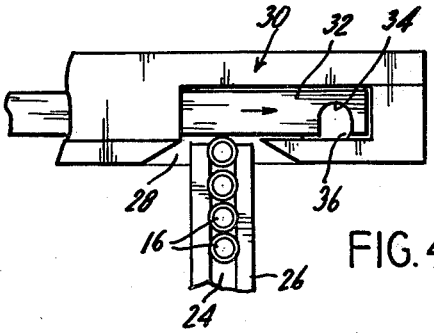
FIG. 4 is a view similar to FIG. 3, except showing the piston in its second position with the seat aligned with the port.
Figure 7:
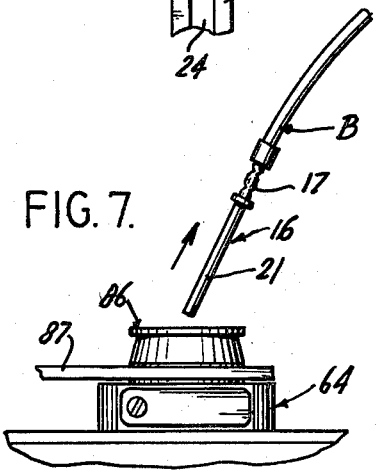
FIG. 7 is an expanded elevational view of the top of the housing and shows the completed wire-pin assembly being withdrawn.

In operation, when main power switch 14 is closed, vibratory feeder 12 is activated, causing the randomly oriented pins 16 to vibrate, thus urging them along bowl track 18 and toward groove 24 of descending feed track 26. Properly oriented pins 16 are urged down groove 24 of descending feed track 26 towards gate 28 included in chamber 30 as can be seen in FIG. 3. To commence the crimping operation, the apparatus is primed; that is, a first pin is manually placed into entrance 68 of bore 66. A wire A is urged in the direction shown in the arrow of FIG. 5 through entrance 68 so that bare end A° of wire A communicates with wire-receiving seat 17 of pin 16. By further urging wire A in the direction shown in FIG. 5, the action of retaining ball 78 is overcome, and spring 80 is compressed, allowing wire-receiving seat 17 to move past the position of retaining ball 78. By this action, elongated point 21 of pin 16 communicates with plunger 106, which thereby activates microswitch 72, as can be seen in FIG. 6. With current thus flowing between terminals T4 and T6 (see FIG. 8), the electro-pneumatic assembly 120 is activated, and crimping dies 90 crimp wire-receiving seat 17 of pin 16 about bare end A° wire A as can be seen by reference to FIG. 6. This is a momentary action, and once the crimping is completed, crimping dies 90 return to their position as shown in FIG. 5. This allows for completed wire-pin assembly B to be withdrawn as shown in FIG. 7. By the activation of microswitch 72, and thus the flowing of current between terminals T4 and T6, after a predetermined time (determined by the time necessary to allow the operator to withdraw the completed wire-pin assembly), coil 50 and armature 40 are activated, momentarily causing piston 32 to be displaced from the first position as shown in FIG. 3 to the second as shown in FIG. 4. Referring to FIG. 3, a pin 16 is disposed in seat 34 of piston 32, with seat 34 being aligned with gate 28. As the piston 32 is momentarily displaced to the position of FIG. 4, seat 34 becomes aligned with port 36, pin 16 is discharged from port 36, enters wide opening 58 of chute 56, travels down chute 56 and exits at narrow opening 60, adjacent to entrance 68 of crimping assembly 62. Pin 16 is now in the suspended position as shown in FIG. 5. When the operator urges another wire A in communication with wire-receiving seat 17 of another pin 16, the operation is repeated as described above.

Piston 32, chamber 30, and upper and lower sections 86–88 of crimping assembly 62 are replaceably mounted on the apparatus, and can be exchanged for other such assemblies of different internal dimensions. Thus different pins of different sizes can be used with only a change in these relatively inexpensive parts, leaving the more expensive components intact. This provides for ease and economy of operation.

Although the invention has been described in terms of a specific embodiment for illustrative purposes, it will be appreciated by one skilled in the art that many additions, subtractions and modifications are possible without departing from the spirit and scope of the invention as defined in the accompanying claims, and therefore the appended claims are to be broadly construed.

I claim:

1. An automatic crimping device for use with a pin having a wire-receiving seat axially aligned with an elongated point, said automatic crimping device comprising: a chamber including a gate with a port displaced from said gate; supply means for providing a continuous flow of said pins at said gate; positioning means for selectively displacing one of said pins through said chamber from a first location adjacent said gate to a second location discharged from said port; a housing including an entrance positioned to receive a pin discharged from said port, a bore axially aligned with said entrance, a plurality of crimping dies in normally spaced relation with each other and radially disposed about said bore below said entrance, actuating means mounted within said bore below said crimping dies, and means for selectively displacing one of said pins from a suspended position removed from said actuating means to an active position engaging said actuating means, when said pin is in said active position its wire-receiving seat being disposed within said bore radially aligned with said crimping dies; and circuit means coupled with said actuating means whereby when said actuating means are engaged, said crimping dies are momentarily urged against the wire-receiving seat of said pin and after a time delay, said positioning means displace another of said pins into said second position.

2. Apparatus in accordance with claim 1 further including a chute having its upper opening disposed adjacent said port and its lower opening adjacent said entrance.

3. Apparatus in accordance with claim 1, wherein said actuating means comprises a microswitch mounted at the bottom end of said bore protruding upward thereinto, and a plunger mounted within said bore resting on said microswitch, said plunger being of insufficient weight to activate said microswitch.

4. Apparatus in accordance with claim 1, wherein said positioning means comprises a piston slideably mounted within said chamber and having a seat dimensioned to receive one of said pins, said piston being momentarily displaceable from a first position in which said seat is aligned with said gate to a second position in which said seat is aligned with said port.

5. Apparatus in accordance with claim 1 wherein said positioning means comprises a piston slideably mounted within said chamber and having a seat dimensioned to receive one of said pins, an armature mounted to said piston, a coil coupled to said armature whereby when said circuit means are activated, after a time delay, said coil urges said piston from a first position in which said seat is aligned with said gate to a second position in which said seat is aligned with said port.

6. A crimping device for use with a pin having a wire-receiving seat axially aligned with an elongated point, said manual crimping device comprising: a housing having an entrance dimensioned to receive one of said pins, a bore axially aligned with said entrance, a plurality of crimping dies in normally spaced relation with each other and radially disposed about said bore below said entrance, actuating means mounted within said bore below said crimping dies, and means for selectively displacing one of said pins from a suspended position removed from said actuating means to an active position engaging said actuating means, when said pin is in said active position, its wire-receiving seat being disposed within said bore radially aligned with said crimping dies; and circuit means coupled with said actuating means whereby, when said actuating means are engaged, said crimping dies are momentarily urged against the wire-receiving seat of said pin.

* * * * *